US010849475B1

(12) United States Patent
Williamson

(10) Patent No.: US 10,849,475 B1
(45) Date of Patent: Dec. 1, 2020

(54) VACUUM APPLIANCE DUSTING ATTACHMENT WITH TELESCOPING FLEXING BRUSH AND INDEPENDENT ADJUSTABLE ACCORDION HOSE ATTACHMENT WITH HANDLE ENDS

(71) Applicant: Kathleen J. Williamson, East Stroudsburg, PA (US)

(72) Inventor: Kathleen J. Williamson, East Stroudsburg, PA (US)

( * ) Notice: Subject to any disclaimer, the term of this patent is extended or adjusted under 35 U.S.C. 154(b) by 49 days.

(21) Appl. No.: 15/451,234

(22) Filed: Mar. 6, 2017

Related U.S. Application Data

(60) Provisional application No. 62/303,903, filed on Mar. 4, 2016.

(51) Int. Cl.

| | |
|---|---|
| ***A47L 9/06*** | (2006.01) |
| ***A47L 9/24*** | (2006.01) |
| ***A47L 9/30*** | (2006.01) |
| ***A47L 5/32*** | (2006.01) |
| *A47L 5/36* | (2006.01) |

(52) U.S. Cl.
CPC ..... *A47L 9/0693* (2013.01); *A47L 5/32* (2013.01); *A47L 9/066* (2013.01); *A47L 9/244* (2013.01); *A47L 9/30* (2013.01); *A47L 5/362* (2013.01); *A47L 9/0673* (2013.01)

(58) Field of Classification Search
CPC ..... A47L 9/0686; A47L 9/0693; A47L 9/24; A47L 9/242; A47L 9/248; A47L 9/30; A47L 9/244; A47L 9/06; A47L 9/0633; A47L 9/066; A47L 9/02; A46B 15/0043; A46B 15/0053
USPC .... 15/396–398, 415.1–422.1, 324, 416, 414, 15/344
See application file for complete search history.

(56) References Cited

U.S. PATENT DOCUMENTS

| | | | |
|---|---|---|---|
| 986,245 | A | 3/1911 | Thurman |
| 2,198,339 | A | 4/1940 | Hamilton |

(Continued)

FOREIGN PATENT DOCUMENTS

| | | | | |
|---|---|---|---|---|
| DE | 102007006389 | A1 | 10/2008 | |
| DE | 102009048852 | A1 * | 8/2010 | ..... A47L 9/066 |

(Continued)

OTHER PUBLICATIONS

Machine Translation of DE-102009048852-A1.*

*Primary Examiner* — Bryan R Muller
(74) *Attorney, Agent, or Firm* — Clinton H. Wilkinson

(57) ABSTRACT

A vacuum dusting attachment comprised of a telescoping brush head on a semi-flexible mounted base, centrally positioned over a disk-shaped piece featuring open apertures for dust collection and edged with lighting, of which the disk's backside narrows to provide a bendable, cushioned, ergonomically designed area for a pinch hold for index and thumb, circumferentially widening to contain a battery chamber for the lighting, extending into a cushioned hand hold area with added non-slippage features, internal friction end to attach to another device or vacuum source hose/wand. An additional independent accordion hose extension vacuum attachment for use with aforesaid dusting attachment or other device, of which the accordion hose is sandwiched between a grip disk and handle allowing to manipulate the hose to desired lengths and bends to reach distant target areas, and collapsing for minimal storage space.

19 Claims, 8 Drawing Sheets

(56) References Cited

U.S. PATENT DOCUMENTS

| | | | | |
|---|---|---|---|---|
| 2,584,515 | A | 2/1952 | Udell | |
| 2,606,338 | A | 8/1952 | De Lorenzo | |
| 2,811,738 | A | 11/1957 | Gall | |
| 3,147,509 | A | 9/1964 | Sieb | |
| 4,053,962 | A | 10/1977 | McDowell | |
| 4,161,802 | A | 7/1979 | Knight et al. | |
| 4,459,720 | A | 7/1984 | Ahlf et al. | |
| 4,553,284 | A | 11/1985 | Strumbos | |
| 4,694,529 | A | 9/1987 | Choiniere | |
| 4,918,857 | A * | 4/1990 | Wade | A01M 1/06 15/330 |
| 4,956,892 | A * | 9/1990 | Fawkes | A47L 5/24 15/339 |
| 4,997,209 | A | 3/1991 | McGrath et al. | |
| 5,050,266 | A | 9/1991 | Schneider | |
| 5,060,341 | A | 10/1991 | Nelle | |
| 5,123,142 | A * | 6/1992 | Miller | A47L 9/0613 15/234 |
| 5,502,870 | A | 4/1996 | Ragner et al. | |
| 5,533,230 | A | 7/1996 | Rouda | |
| D405,570 | S | 2/1999 | Broecking | |
| 5,983,443 | A * | 11/1999 | Redding | A47L 9/30 15/324 |
| 6,026,541 | A | 2/2000 | Bailey et al. | |
| 6,044,521 | A | 4/2000 | Sebek | |
| 6,370,731 | B1 | 4/2002 | Carter | |
| D491,326 | S | 6/2004 | Schroter | |
| 6,802,104 | B1 | 10/2004 | Redd | |
| D513,101 | S | 12/2005 | Allard et al. | |
| 7,418,763 | B2 * | 9/2008 | Shaver | A47L 5/14 15/330 |
| 7,784,137 | B2 | 8/2010 | Knopow | |
| 7,784,149 | B2 | 8/2010 | Schwarz et al. | |
| 8,627,544 | B2 * | 1/2014 | Habboush | A47L 5/24 15/236.01 |
| 8,875,341 | B2 * | 11/2014 | Gooden | A47L 5/26 15/327.5 |
| D733,376 | S | 6/2015 | Bennett et al. | |
| 2005/0050675 | A1 * | 3/2005 | Hsu | A47L 5/24 15/344 |
| 2006/0179607 | A1 * | 8/2006 | Ptak | A47L 7/0057 15/393 |
| 2007/0209154 | A1 | 9/2007 | Griffith et al. | |
| 2008/0086834 | A1 | 4/2008 | Schwarz et al. | |
| 2009/0172912 | A1 | 7/2009 | Knopow | |
| 2010/0170060 | A1 | 7/2010 | Eccardt et al. | |
| 2010/0306954 | A1 | 12/2010 | Coscarella | |
| 2015/0223656 | A1 | 8/2015 | Tucker et al. | |

FOREIGN PATENT DOCUMENTS

| | | | |
|---|---|---|---|
| EP | 0180367 | A3 | 5/1986 |
| EP | 0377801 | A1 | 7/1990 |
| EP | 0931498 | A1 | 7/1999 |
| ES | 2199000 | A1 | 2/2004 |
| FR | 2739275 | A1 | 4/1997 |
| GB | 2276311 | A | 9/1994 |
| JP | 09327423 | A | 12/1997 |
| WO | 2002000086 | A2 | 1/2002 |
| WO | 2008048552 | A2 | 4/2008 |

* cited by examiner

11

FIG. 1D
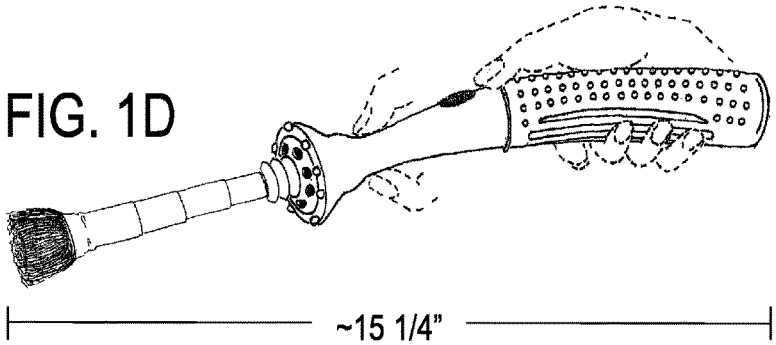
FIG. 1E
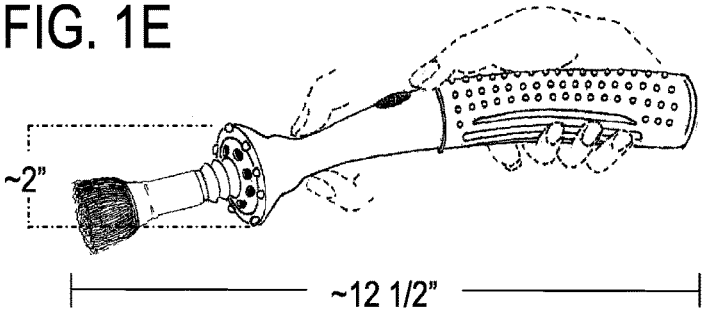
FIG. 1F
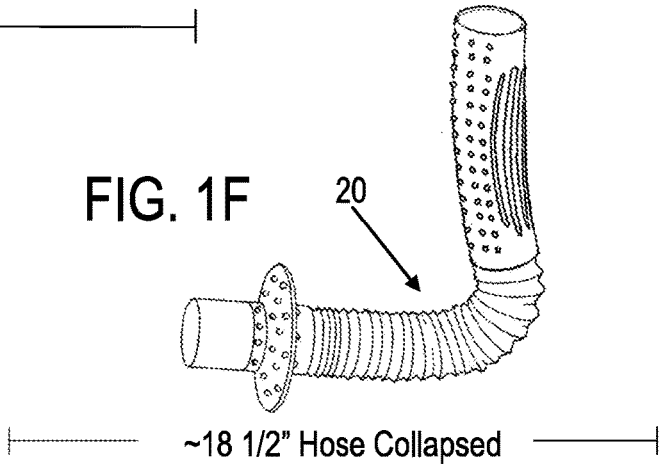
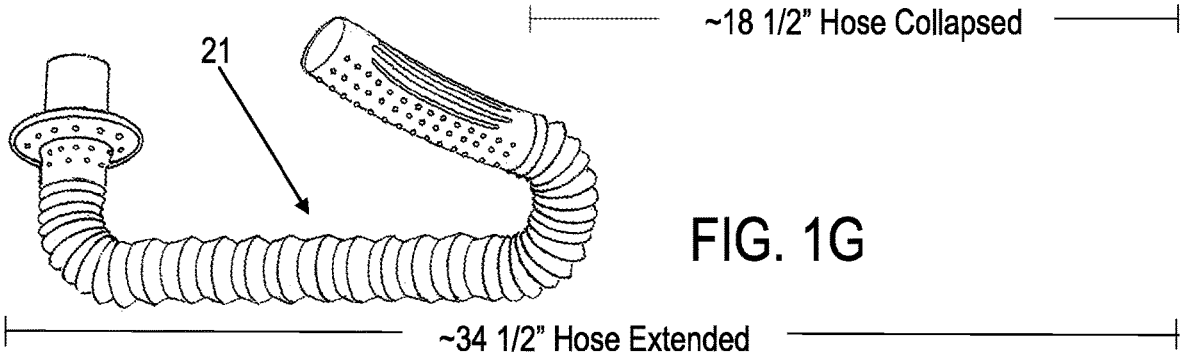
FIG. 1G

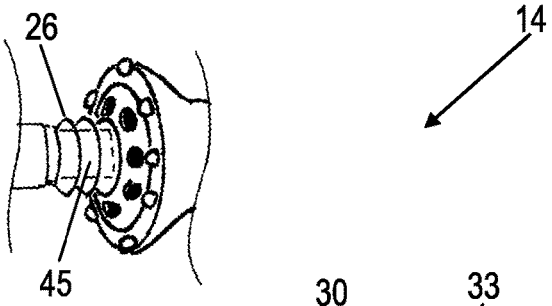
FIG. 3A
FIG. 3B
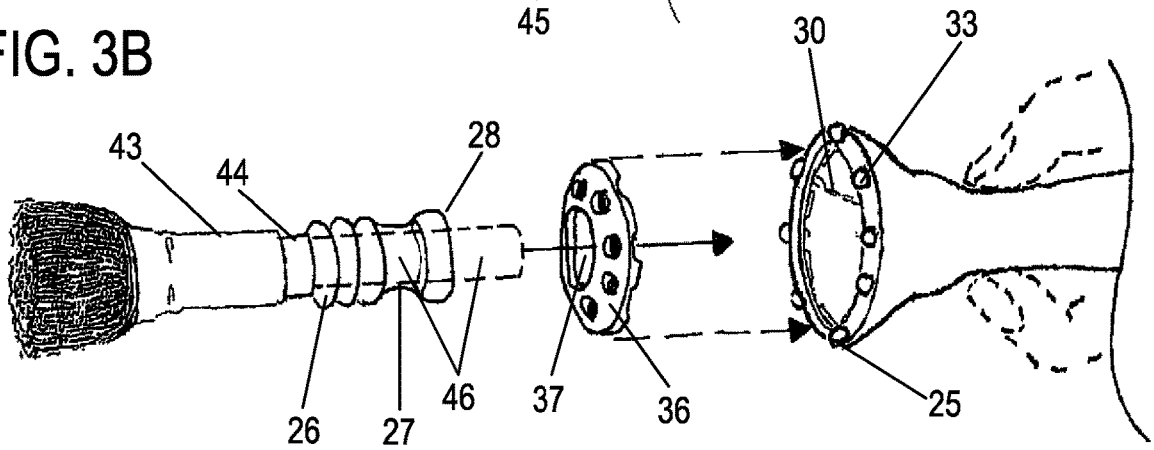
FIG. 4
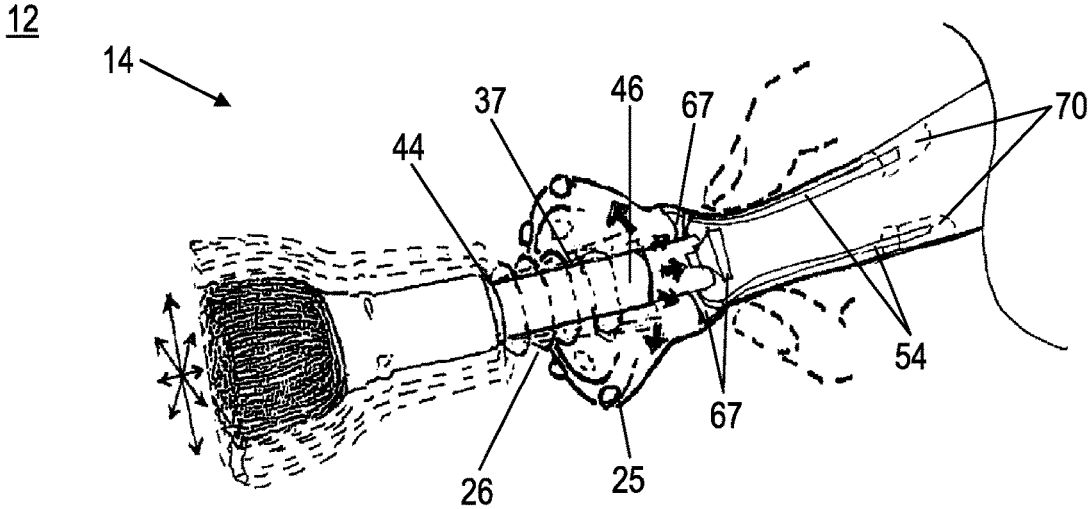

FIG. 5
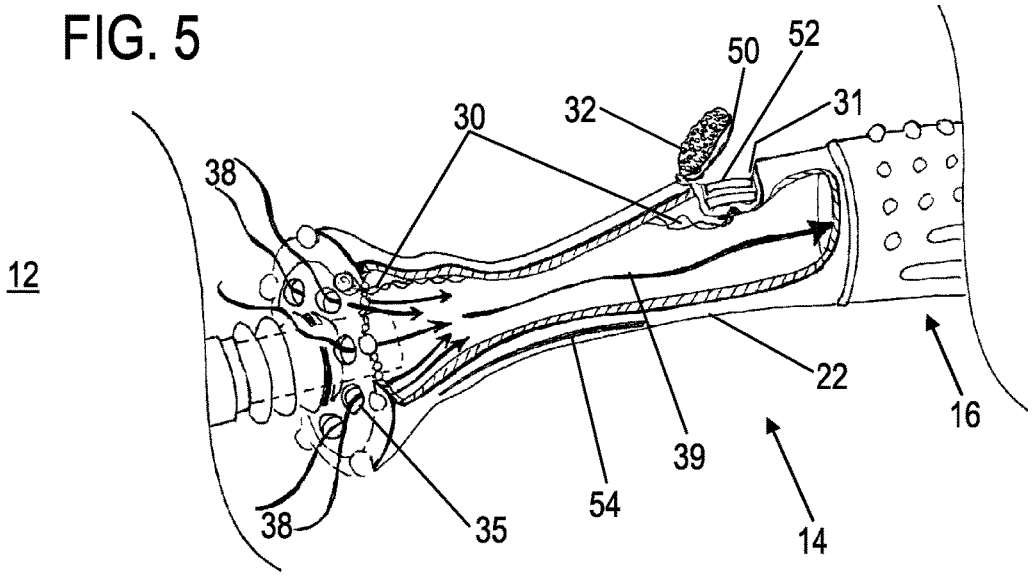
FIG. 6A
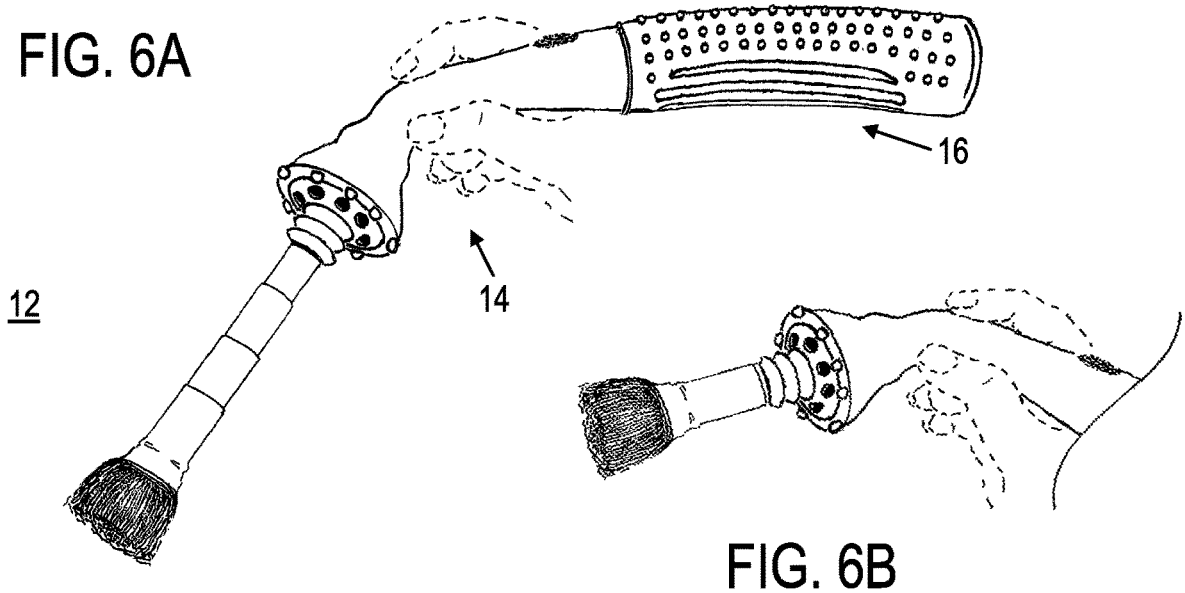
FIG. 6B

12

12

VACUUM APPLIANCE DUSTING ATTACHMENT WITH TELESCOPING FLEXING BRUSH AND INDEPENDENT ADJUSTABLE ACCORDION HOSE ATTACHMENT WITH HANDLE ENDS

FIELD OF THE INVENTION

The present invention relates to attachments and accessory tools for surface cleaning appliances such as vacuum cleaners, and more particularly to an accessory tool with a dusting brush with a base ferrule and including a telescoping extension attached to a flexible mount base, and an ergonomic handle configured for either finger or full hand gripping, and an independent adjustable accordion hose attachment with a grip end and an ergonomically superior handle.

BACKGROUND OF THE INVENTION

Surface cleaning appliances such as vacuum cleaners for cleaning floors, upholstery, and other surfaces in a home or workplace are generally known in the prior art. The most popular household vacuum cleaners are either upright standing or canister style vacuum cleaners, although other more specialized types such as handheld vacuums, central air vacuum systems, electric brooms, and shop vacuums are also available. Household vacuum cleaners typically include a primary electrically motorized surface cleaning component which includes a spinning rod having a series of affixed stiff bristles segregated in individual circumferential rows to create a rolling brush for cleaning floor areas such as rugs or hard floor surfaces by repeatedly passing the surface cleaning component across the surface to be cleaned in a generally back and forth motion, whereby dirt and debris is collected into a bag or receptacle by a suction force created by a vacuum unit. Canister style vacuums allow for the handle to detach from the surface cleaning component and then be attached to other cleaning attachments. The canister handle is attached to a flexible extension hose that is attached to the vacuum unit. Most upright vacuum cleaners are equipped with a separate flexible extension hose that is connected independent of the surface cleaning component. Both the canister style vacuum handle and the upright vacuum flexible hose end with a rigid coupler hose for attaching various vacuum attachments such as rigid extension hoses and/or purposed cleaning attachments that are designed to clean those areas that cannot be cleaned by the primary roller brush component used for flooring.

There are many vacuum device attachments on the market today which vary in shapes and sizes to accommodate various cleaning projects. For instance, a crevice tool can be used to clean between cushions and in another instance a stiff bristled brush tool is used to vacuum debris from the top surface of a cushion. The present invention, however, is primarily concerned with those attachments that are used for dusting surfaces which require detailed cleaning such as statues, knick-knacks, computer screens and keyboards, and the like, which typically do not conform to standard shapes. There are limited attachments available for intricate dusting purposes. Rigid extension hoses are also available which are placed between the vacuum's flexible hose and an attachment to reach further areas out of reach. A common problem that occurs is that upon the purchase of a vacuum machine the assortment of attachments provided do not cover all the cleaning needs of a home or workplace, especially for the purpose of dusting in a comfortable and thoroughly complete manner. To fill the various cleaning needs, the consumer therefore must purchase additional vacuum attachments that are more applicable to their specific cleaning chores. These additional purposed vacuum attachments may be purchased either from the original vacuum manufacturer or a similar or better designed vacuum attachment may be purchased from a different manufacturer.

When close up or distant dust cleaning is required, currently available attachments on the vacuum market do not meet the basic dusting needs of the consumer. Especially for close up dusting, a consumer usually resorts to the old fashioned method of dusting by hand by the employment of the use of a feather duster and/or a rag, since the available vacuum dusting attachments are too bulky, or odd shaped to fit in particular spaces and/or the difficulty of directing the aperture opening over the area to be vacuumed, especially when dusting delicate and intricately shaped items. In addition, most of the available attachments on the market today are rigid throughout the whole of the attachment where a flexible area, if included, is usually in one location only, limiting directional movement of the vacuum attachment. An example of this would be an attachment that reaches under furniture, where the attachment bends only at one point so as to allow the attachment to flatten out so the consumer does not have to lay on the floor to guide the direction of the attachment. Most vacuum attachments are usually fixed in a set or limited radii positions once affixed onto a rigid extension hose, and when affixed to a flexible vacuum hose, a comfortable grip for the hand is lacking, thus taxing the consumer's hand, wrist, and so forth, limiting the flexibility of cleaning as well as limiting the ability of the consumer to reach specific target areas to be cleaned with a delicacy required for dusting delicate and/or awkward areas such as inside shelf corners, statuettes, decorative plants, intricately designed lamp bases, around exterior surfaces and disk intake ports of stereo equipment, Venetian blinds (especially around the vertical slate holding strings), computer keyboards, computer tower air vents, and such. Some attachments are so unwieldy as to be of little use at all, having no handle to grasp and as a result usually requiring the consumer to expend too much effort of using their hand, wrist, or body maneuvering while they endeavor to accomplish the same chore that ends up being easier to accomplish with a rag or feather duster. Much time is also expended in changing various different attachments while seeking the desired cleaning effect. Since the feather duster and/or a rag while dusting usually just re-spreads the dust back into the household air, the dusting chore is short lived as this newly disturbed air-borne dust simply resettles upon other surfaces. Sometimes a consumer will try to use both the vacuum and a feather duster or a similar duster by leaning the open vacuum hose near the area to be dusted hoping that the newly released air-borne dust is transferred into the vacuum receptacle. The consumer is already burdened down by having to carry around specific purposed cleaning attachments, rigid extension hoses for distant out of reach areas, and then is further burdened by also carrying around additional feather dusters, rags, and such, with their accompanying cans/bottles of spray and liquid cleaners.

The consumer encounters further problems with vacuum attachments especially with grasping the wand and/or the attachment when attached together. Since to the knowledge of the inventor a comfortable handle to grasp is not included on most attachments, any time an attachment is affixed to a corresponding hose, the hand is forced to endure the uneven crack formed between the two attachments so as to use the wrist to guide the attachment in the desired direction. The consumer therefore resorts to holding the rigid wand, or the uneven connected site area, especially when using the flexible hose and rigid coupler hose extending out of the upright vacuum cleaner. Even though the canister vacuum's flexible hose ends in a handle before an attachment is affixed to the rigid coupler hose, the consumer's use of the canister vacuum handle will find that the grip is usually oversized, awkward, and on the heavy side, due to the handle's original intent of use for directing the path of the main motorized primary surface cleaning component, and not necessarily designed to enhance nor being convenient to use with individual affixed attachments. So using either the upright or the canister vacuum cleaner, the consumer encounters physical discomfort while trying to dust. Many modern consumer devices, from kitchen utensils and so on, have a handle which is made to fit comfortably in the user's hand, and are made of a soft thermal plastic rubber (TPR) material, hard silicone, or a combination of other hard and soft materials. Such comfort handles are beneficial to all users and particularly to the many individuals that suffer from carpel tunnel syndrome, osteoarthritis, and other painful maladies of the hand, wrist, arms, and back. In addition to a softer and a more comfortable grip handle devices offered in other markets, they are also sometimes manufactured with grip-like protrusions so the user has in their possession a slip resistant article, which is invaluable when a cleaning chore produces sweat on the individual's hands. There is therefore a need for a vacuum attachment tool that can be used to easily and effectively pick up dust and small particles which has an ergonomic and comfortable handle which makes holding and manipulating the device easier in a more effective manner, while also being able to move in a specific direction when needed.

Another problem with vacuum dusting attachments is that for the most part there is nonexistent or inadequate lighting incorporated in the individual attachments themselves which would facilitate seeing the dusting area to be cleaned, especially areas that are in shadow such as behind other items on a shelf, or the lighting due to the time of day. Usually only the motorized primary surface cleaning component is complemented with lighting to light up the area in front of it to be vacuumed, but it would be especially an advantage to have peripherally overall lighting on an attachment to be able to see all surrounding areas that are being vacuumed, thus speeding up the cleaning process. The obvious advantages of including lighting on an attachment itself are twofold, as it lights up the area to be dusted, as well as the emitted lighted beams allow the consumer to actually see and confirm that the dust nodes are being sucked up into the vacuum attachment. Unfortunately, because of the lack of proficient lighting on vacuum attachments, a consumer might devise to precariously place a lamp closer to an area, or employ the uncoordinated use of a flashlight to obtain the same results.

As aforementioned above, rigid extension hoses become unwieldy and heavy to maneuver while using an attachment at their farthest end. Additionally, rigid extension hoses are of a determined length. When a consumer needs an attachment to reach a distant area to be cleaned, one rigid extension hose might be too short which might necessitate the consumer to stand dangerously on ladders or furniture. When additional rigid extension hoses are added to reach the target area, the hose length might be over-long causing the consumer to then move furniture out of the way so as to be able to move backwards. If unmindful while focusing on the distant vacuum attachment while cleaning, there is the possibility of the consumer tripping and falling backwards over furniture, or even falling backwards down stairs. Besides trying to match the distance required, the consumer will become frustrated further trying other various ways of focusing the rigid vacuum attachment's aperture opening to the target area using the inflexible and unbendable rigid extension hose.

BRIEF SUMMARY OF THE INVENTION

Accordingly, it is the intention of the present inventor to provide an improved lightweight, handled equipped vacuum dusting attachment and a flexible lightweight independent accordion hose vacuum attachment. In the preferable mode, the vacuum dusting attachment device includes two sections, a cleaning portion and a handle portion, which together could be made of several parts or of a singular part. The accordion hose attachment would replace rigid extension hoses and includes handles on both ends for holding, extending, collapsing, and bending the hose to desired shape and length to reach cleaning target areas while supporting the weight of aforesaid attachment or other types of attachments.

In accordance with the present invention featured in the drawings, there are two sections that make up the vacuum dusting attachment device: a cleaning portion and a handle portion. The cleaning portion includes a paint brush-style head, usually referred to as a "mop" brush in the painting artists' market, and similarly, the hairs on one end of the brush are enclosed in a metal ferrule which holds the bristle hairs in place. There are dusting appliances where the open apertures are placed between or centered within the hair bristles or feather-like extensions, but a concentrated mass of bristles creates increased friction upon surfaces to be cleaned as well as being able to access smaller surface areas. In the preferred embodiment, the ferrule includes an extended lower section which becomes part of a telescopic extension to obtain further detailed cleaning length choices, but the product could be devised without a telescopic feature. The mop brush and ferrule/telescope is attached preferably to a semi-flexible mount, which becomes an axis point allowing a pivotal sway of the mop brush head as it contacts items to be cleaned, saving the consumer from extra hand movement. The base, or end of the telescoping extension in an embodiment is a solid pin inserted and affixed to the internal sides of the semi-flexible mount which is made of a flexible material like, but not limited to, rubber that equals the length of the pin of which both could end at the top and affixed to the open apertures disc, but preferably the telescopic solid pin encased with the rubber mount material can be extended and inserted into and through the center of the disk and extend beyond with supporting ribs and possible extensions from those ribs, include bendable wiring to insert into pockets formed in the interior of the neck in the injection molding process. The disk-like portion has open aperture holes purposed to draw in dust particles that the brush head dislodged or "brushed off" while in the process of dusting. Peripherally surrounding the open apertures disk are light bulbs, or any other sort of functional lighting type source, provided to assist in the visual efficiency of the vacuum dusting attachment while dusting, as well as to be able to see the dust nodes being collected by the aperture holes. In the preferred embodiment, the lights would encircle the disk-like area, so the area to be dusted would be circumferentially lighted, but the lights are not limited to this placement. The accompanying Figures are used for description purposes and do not limit the possible shapes, sizes, and placement of the individual pieces of the forward portion of the cleaning portion of the vacuum dusting device. For example, the open apertures could be square, or even a screen, etc.

Behind the brush/telescope dust gathering "disk-like" portion and lights, the cleaning portion of the vacuum dusting attachment narrows into a hollow neck area that is made so as to provide a soft and cushioned area where the consumer can hold and direct the device in essentially the same manner that a painter may hold a paint brush, or a writer holds a pen, giving extreme detailed control while in the act of dusting. This neck area may be made of a material such as a soft bendable plastic, or even a hard silicone rubber of which it could further be devised that bendable wire/s could be inserted or molded within the narrow neck walls of the device allowing this finger hold area to be bendable in different directions allowing the device, and not the consumer's hand to do the bending for awkward and hard to reach target areas. Internally this narrowing of the neck will also concentrate the vacuum suction of which would increase the drawing power of the open apertures.

Referencing again to the neck area of the cleaning portion of the vacuum dusting device, continuing from the narrow finger hold area located just behind the aperture/light disc, the neck area circumferentially widens, and just short of where the handle portion begins, a battery chamber is inserted. If batteries are the choice, the smallest available would be used, and the wiring from the battery chamber would connect to a bulb which then connects to a continuing string of lights. There are other sources for the lighting system such as solar power and so forth which would be determined during manufacturing. Quite possibly a charging pin port could be incorporated on the vacuum dusting device whereby the lights/battery/s are charged on a specially designed vacuum unit itself and/or a wall charging station which would have complimentary charging ports. The battery chamber would be covered externally on the surface by a soft airtight push on/off switch. The exterior off/on switch button would be soft and flexible so as to push on and off, and be located in an area so as not to cause the consumer discomfort in the use of the device, yet conveniently located to activate. If a battery and wiring system is to be used, then it would be desirable that a portion of the dusting device be able to be opened, or have a sufficient opening end, so as to repair, replace, etc. the wiring system.

Also on the surface of the neck area, there is room to add a vacuum suction control to increase or decrease incrementally the vacuum suction, which gives more control to the consumer to vacuum delicate items. One vacuum suction control option would be to place a circular or circumferential piece with an opening to correspond with an opening on the device itself, so when spun around the hole on the device, the vacuum suction is controlled by opening and closing to desired increments. Another control option would be to provide a sliding door over the open hole in the device which accomplishes the same. The location of the suction vacuum control on the device will be chosen so as not to interfere with the operation or comfort of the device by the consumer.

The handle portion of the vacuum dusting device is designed as a conduit for vacuum suction but is shaped ergonomically for the consumer's hand to hold the device in comfort. As with other vacuum attachments, the open nozzle end will frictionally attach to the independent accordion hose vacuum attachment, the flexible hose coupler deriving from the vacuum unit, or other various extension hoses. The coupling ends of both the vacuum dusting attachment and the accordion hose vacuum attachment will ideally be manufactured as closely as possible to be able to couple with the current vacuums on the market today, but due the manufacturing specification varieties between manufacturers, a coupler might be needed, but a dedicated vacuum machine and an assembly of corresponding attachment parts could be devised as well, and if so, it might be an advantage to incorporate a complimentary single or double threaded screw ends on each device to prevent separation of the devices while cleaning. However the coupling of the attachments are devised, it is apparent that having the handle end to have an internal coupling nozzle as opposed to an external and protruding coupling end will further lighten the weight of the attachment overall.

The portion of the handle which the hand grips is ergonomically shaped for comfort and is coated in a soft, possibly even padded-like material, while the interior would be a more substantial rigid material which would retain the handle shape and support the end nozzle for friction coupling with the accordion hose or other hose/wand attachments. Protruding upwards, or engraved upon, and around the handle area are bumps and ridges which provide a better grasping grip area, especially when the hand becomes sweaty. These bumps and ridges could be created in the manufacturing process of the soft outside coating of the handle, but consideration should be given in materials chosen in the manufacturing of the attachment overall so as to keep it lightweight and balanced throughout.

The independent adjustable accordion hose extension vacuum attachment with a grip end and a ergonomically designed handle, of which is the same handle used on the paint brush vacuum device, would replace the use of, or in conjunction with rigid extension hoses currently used when trying to reach distant target areas and would ideally be made with, but not limited to, a plastic which would be sturdy enough so as not to collapse from the vacuum suction, yet flexible to shape and maintain a bend chosen in the desired direction with ease, and easy to extend and collapse, yet lightweight. The material chosen for the accordion hose device would ideally withstand repeated usage without cracking. The hose provides a lighter and easier accessory to use than a rigid extension hose and has its own handle to use while directing the vacuum dusting device towards a distant target area. If more accordion hoses are stacked together for extended length, there is always a handle close to the consumer to grasp. With the ability to expand and collapse to any distance desired within the realm of being total collapsed and the full extension of its manufactured limitations, it makes reaching target areas to be cleaned more manageable and flexible, especially with its ability to be bent by the consumer in any direction desired. Because the bellows of the accordion hose will be manufactured specifically to a hard thickness which won't collapse from the vacuum suction, the total expanded opened length should be manageable by a consumer, where a full extension of the hose should match the width of a standard consumer's width of the arms, approximately two feet. If additional distance is required, another accordion hose device could be attached, or as many as the consumer needs, since all the described vacuum attachments within the scope of the invention are coupler compatible, but other hoses and such could also be used, even if another manufacturer's adapting coupler is required. The accordion hose vacuum attachment's disk grip and the handle of which is the exact same handle used on the vacuum dusting device, are placed at the ends of the accordion portion specifically for making it easier for the consumer to pull out and expand the accordion hose, for pushing in to collapse the accordion hose, and bending the accordion hose. Another version of the accordion hose vacuum attachment may have the disk grips on both ends, and/or a smaller handled coupler. Although the exterior of the handle will be ergonomically shaped, the internal hollow tube of the handle would be straight for coupling and for facilitating straight suction direction projection. The other advantage is that the accordion hose portion collapses approximately a third of its fully extended length which makes it beneficial for storage and for carrying the accordion hose device around.

The grip disk of the accordion hose vacuum attachment is located behind the protruding coupling nozzle end that is inserted into another vacuum device and before the accordion hose begins, and is made of a sturdy material but is coated with, but not limited to, a soft material such as TPR with the raised bumps and/or ridges similar to the handle on the vacuum dusting device's handle so as to provide a comfortable and ergonomic grasping handle for the consumer. This coating would cover both sides of the disk and continue towards the accordion hose as its circumference decreases down to match the width of the accordion hose.

The accordion hose device is attached between a vacuum dusting attachment device and the vacuum cleaner output hose, or other hoses attached to the vacuum cleaner. When the consumer prefers to hold the handle of the vacuum dusting attachment device for close up vacuum cleaning chores, leaving the accordion hose device/s attached allows the consumer freedom of movement, swing action, and expansion and reaching distance behind them, as well as flexibility of movement of the dusting attachment as opposed to a rigid extension hose. Even though the upright vacuum cleaner has a flexible output hose derived from the vacuum receptacle, adding the independent accordion hose attachment will add additional flexibility and maneuverability for the consumer while using a dusting attachment, and significantly increase the distance from the vacuum cleaner to the area to be cleaned. When using the accordion hose device with a canister vacuum, a consumer can increase their comfort by attaching the accordion hose device to the overlarge and heavy rigid handle, then dropping the canister handle and taking up the vacuum dusting attachment handle attached to the other end of the accordion hose for improved flexibility, comfort, and added distance while using the vacuum dusting attachment for close up cleaning.

It is planned that the vacuum dusting attachment device and the accordion hose attachment device, and quite possibly a dedicated designed vacuum machine, would be sold together and be accompanied with a convenient carryall bag, or other receptacle, or cart, to carry the devices over the consumer's shoulder, or around the waist, or a unit for wheeling/dragging around, while cleaning. It should also be noted that the vacuum dusting device and the accordion hose device would be compatible for use with other vacuum attachments and hoses, although on some vacuum models an adaptor or a coupler might be needed to connect between different manufacturer's products since many manufacturers in the vacuum industry are not consistent in their measurements. A specially designed vacuum machine and corresponding attachments might also be devised where the specially designed vacuum machine could be so enabled to allow attachments to be manufactured with a strip of coefficient conductive material to relay power to the attachment/s lighting system from the vacuum machine, or the attachments can have compatible pin ports to plug into the dedicated vacuum machine.

The dusting attachment brush head and lighting allows the consumer to be able to dust delicate items such as figurines, intricate nook and cranny areas, keyboards without depressing the buttons, and so forth. The accordion hose device allows the attached dust attachment or other vacuum attachment to reach incremental distances and awkward bends to reach specific items and parts thereof.

The overwhelming purpose of the present invention it to provide a lightweight, comfortable, and effective dusting apparatus that is easy to use by the consumer. Although a handle is unique for vacuum attachments and an advantage especially for close up cleaning, it may also be advantageous for the invention to be alternatively manufactured in several parts so as to be more practical for use when long distance cleaning is required, allowing a straight directional line to the area being cleaned while also minimizing total weight of the assembled unit. In this embodiment, the handle would be separate or independent from the cleaning portion, a shorter handled coupler would be provided, and the accordion hose would feature a grip end on both ends replacing the handle on the opposite end.

While the present invention is being particularly designed for use in the vacuum industry, it could be repurposed for the painting industry or other industries that could benefit where the cleaning portion is devised as a non vacuum purposed piece, but is still bendable and possesses lighting, (the mount in this example case would not be flexible) and which would also possess on the top area of the cleaning portion interchangeable telescoping and different shaped and sized paint brush head sizes that could be interchangeable similar to an electric drill's collets and drill bit interchange process, or another interchange method (for example, brush heads could be changed above the telescope, or the brush and telescope as one piece could change out on the disk area), but retain a hollowed ended handle for coupling, then the accordion hose could still be used, and if the hollow ended handle and/or incorporated an internal thread screw, a telescoping pole which is common on the market today could also be used, and of which this new purposed invention could immensely improve painting techniques and other markets for intricate and long distance painting, within the household and industrial painting market.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 1D illustrates the approximate line measurements of the vacuum dusting attachment with the telescope extended.

FIG. 1E illustrates the approximate line measurements of the vacuum dusting attachment with the telescope collapsed.

FIG. 1F shows the line measurements of the optional use accordion hose vacuum attachment when the hose portion is fully collapsed FIG. 1G shows the line measurements of the optional use accordion hose vacuum attachment when the hose portion is fully expanded.

FIG. 3A shows a shortened internal rod at the bottom of the telescope encased in a mount.

FIG. 3B is a breakaway view illustrating a longer internal rod encased in the mount that intersects with an insert disc, and where the insert disk is detached from the neck portion of the device.

FIG. 4 illustrates a partial cut out view of the detailed brush/telescope end of the cleaning portion of the vacuum dusting attachment of the invention and illustrates flexible swaying movements of the brush head.

FIG. 5 is a partial cut out view of the cleaning portion of the vacuum dusting attachment showing the internal features of the neck area and directional arrows indicating the path of the vacuumed captured dust particles.

FIG. 6A shows the vacuum dusting attachment of the invention in a telescoping position and bent for specific directional cleaning which could be facilitated by inserting a bendable wire in the neck area FIG. 6B shows a view similar to FIG. 6A in a retracted position.

DETAILED DESCRIPTION OF THE INVENTION

The following detailed description is of the best mode or modes of the invention presently contemplated. Such description is merely exemplary in nature and is not intended to be understood in a limiting sense, but to be an example of the invention presented solely for illustration thereof, and by reference to which in connection with the following description and the accompanying drawings one skilled in the art may be advised of the advantages and construction of the invention.

Figure 7:
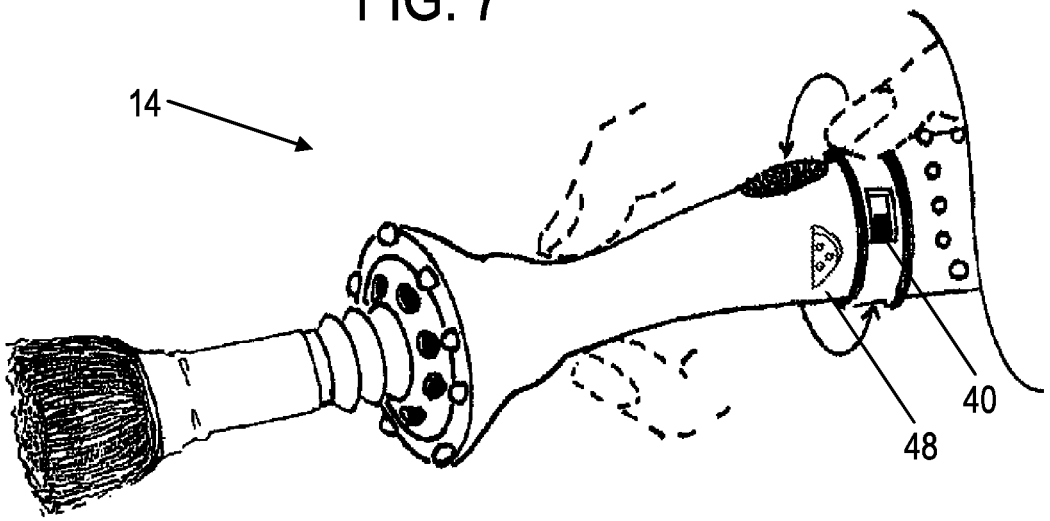
FIG. 7 is a partial view of the dusting attachment device showing an adjustable circumferential vent to control vacuum suction and a possible charging pin port.
Figure 8:
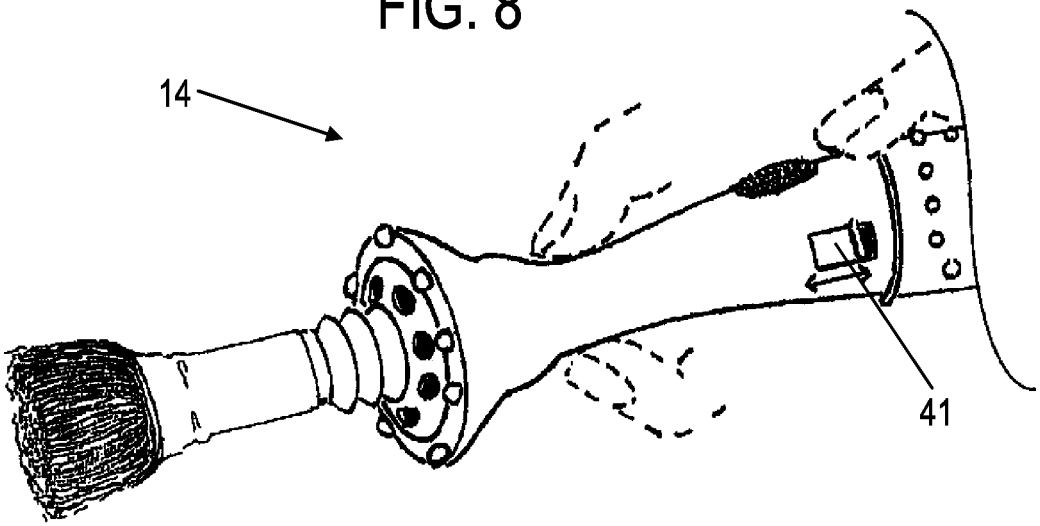
FIG. 8 is a partial view of dusting attachment device showing an adjustable slide vent to control vacuum suction.
Figure 9:
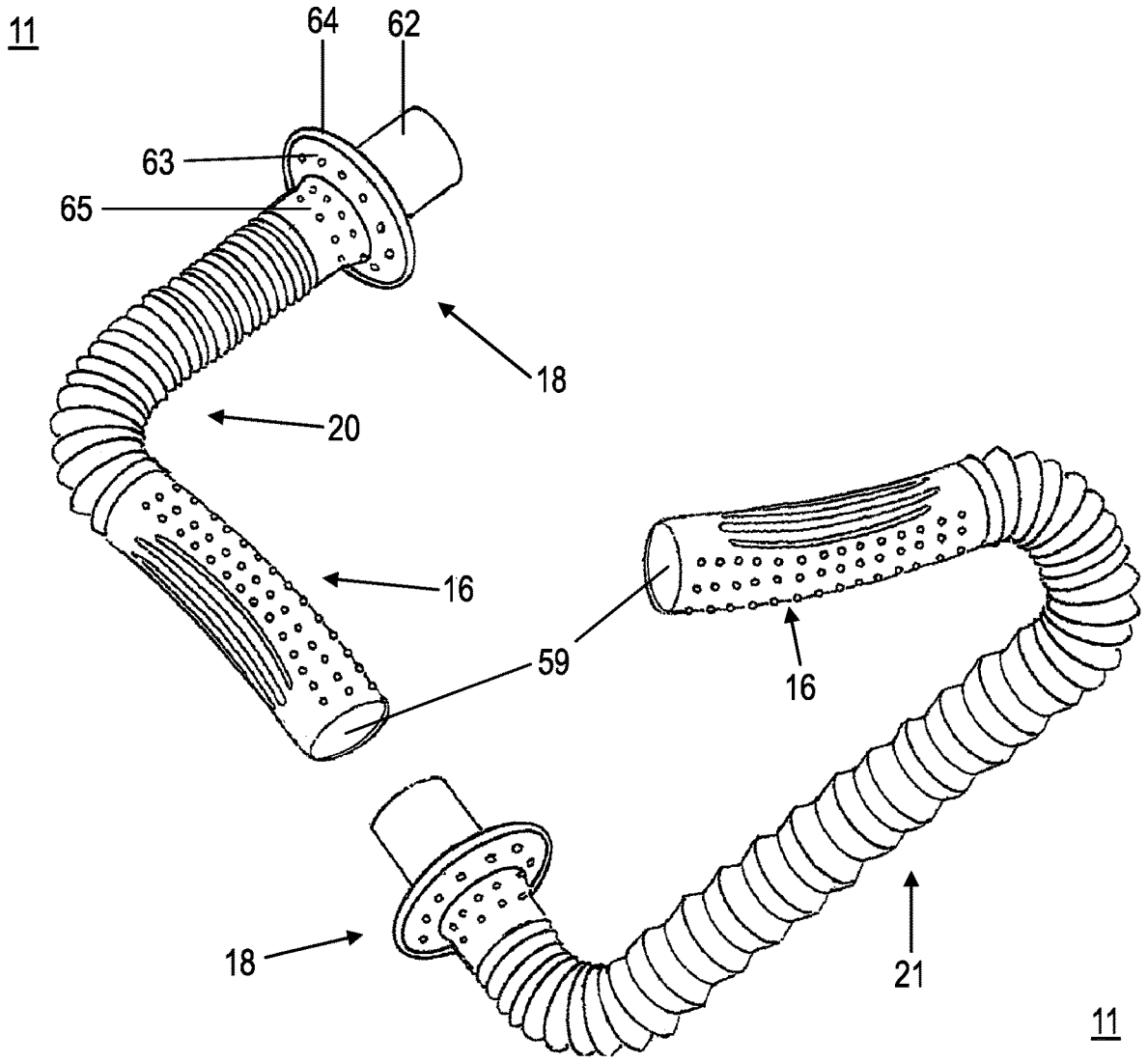
FIG. 9 illustrates the optional use accordion hose vacuum attachment where the upper left view the accordion hose is partially collapsed, and the bottom right view the accordion hose is partially expanded, and further illustrates the capability of stacking the hoses to attain larger distances.
Figure 10A:
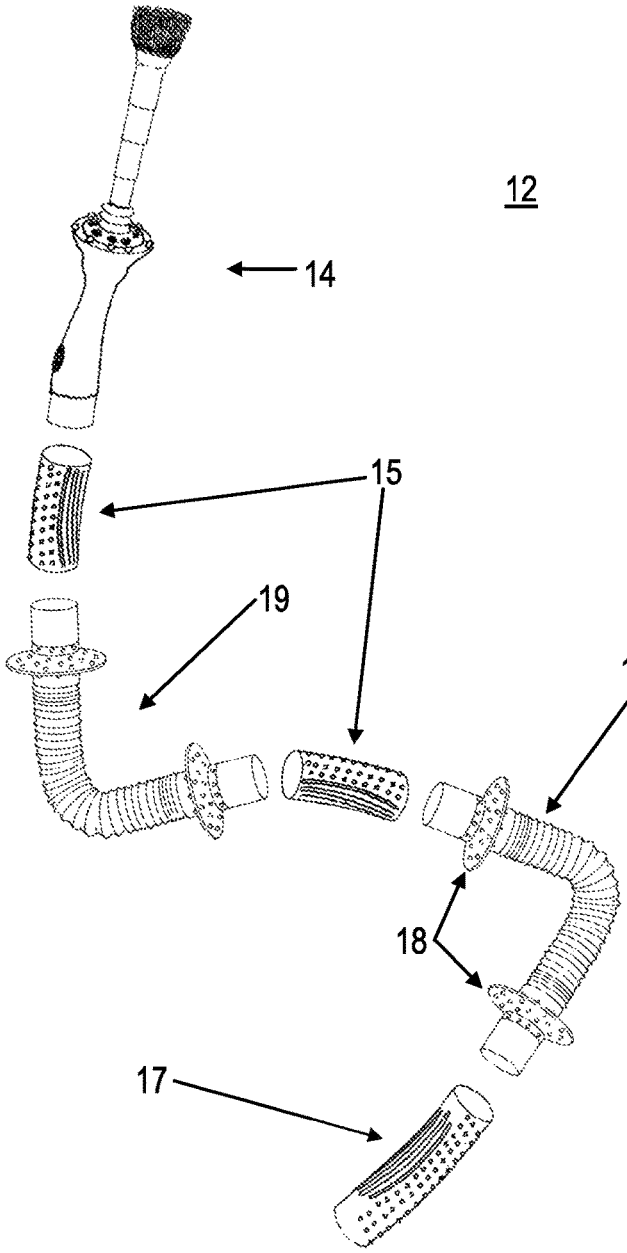
FIG. 10A illustrates first alternative arrangement of the dusting attachment and accordion hose vacuum attachment in which the handle is an independent part from the cleaning portion, grip disks are attached to both ends of the accordion hose, and a newly devised handle coupler is employed.
Figure 10B:
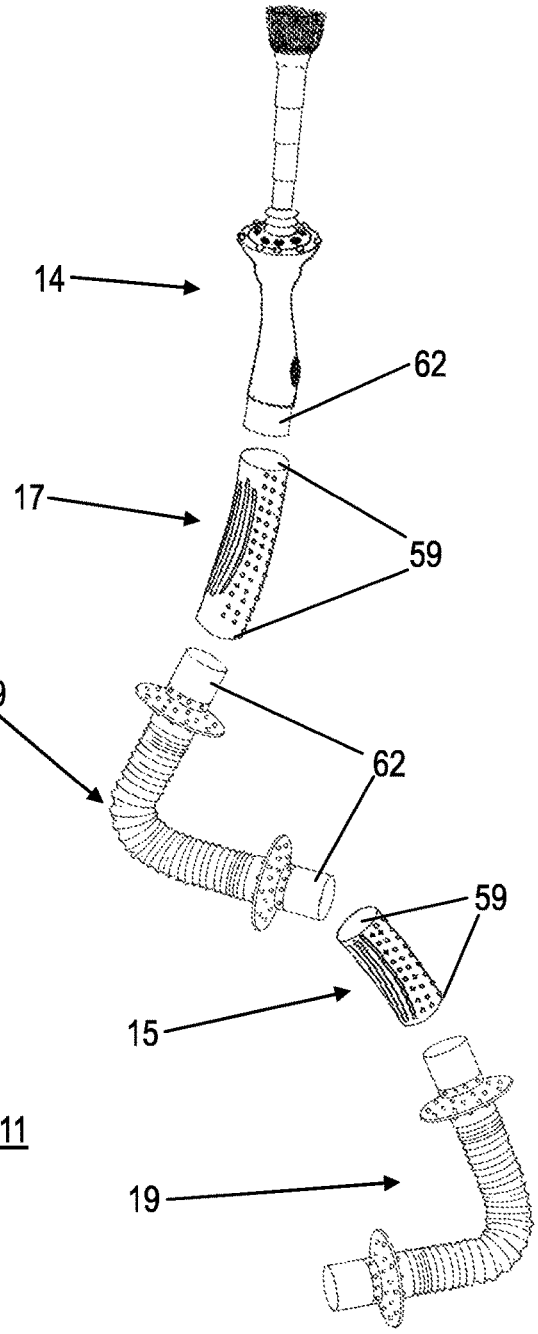
FIG. 10B illustrates a second alternative arrangement utilizing the components of the invention illustrated in FIG. 10A.

FIGS. 1-10 illustrate several embodiments of a vacuum cleaner dusting attachment device 12 and optional use accordion hose vacuum attachment device 11 in accordance with the present disclosure. FIGS. 1D-1G include approximate measurements of the invention in various angled, extended, and retracted positions. As shown in FIGS. 1, 2, 6, and 10, the vacuum cleaner dusting attachment device 12 is generally comprised of cleaning portion 14 and handle portion 16. It is preferred that device 12 is made in as few pieces as possible. In an embodiment, the majority of device 12 is made in a process of injection molding, of such material as soft Thermal Plastic Rubber (TPR), hard silicone, or of a similar material, and where other parts and/or pieces are made of materials suitable to allow for individual purposes such as a bending wire, telescoping metal, wiring, lights, etc. Accordion hose attachment device 11 is shown in FIG. 1F and the upper illustration in FIG. 9 with the accordion hose portion 20 in a mostly collapsed position, and in FIG. 1G and the lower illustration in FIG. 9 in a mostly extended position. FIGS. 9 and 10 present the stacking of device 11 in the illustrations which represents the ability to connect additional units of device 11 so as to present the possibilities of increasing the length of distance of reach that can be obtained by using multiple units of device 11 so that device 12 or other vacuum device attachments can be operated to collect dust from unusually far distant and hard to reach areas that need to be dusted. In addition, FIGS. 10A and 10B an embodiment of device 12 is shown where the cleaning portion 14 and the handle portion 16 are provided as separate components or parts, and device 11 includes disk grip 18 replacing the handle end 16 on one end of the accordion hose, and a shortened handle coupler 15 is provided, such that devices 12 and 11 may be assembled in a variety of configurations.

Figures 1A, 1B, 1C:
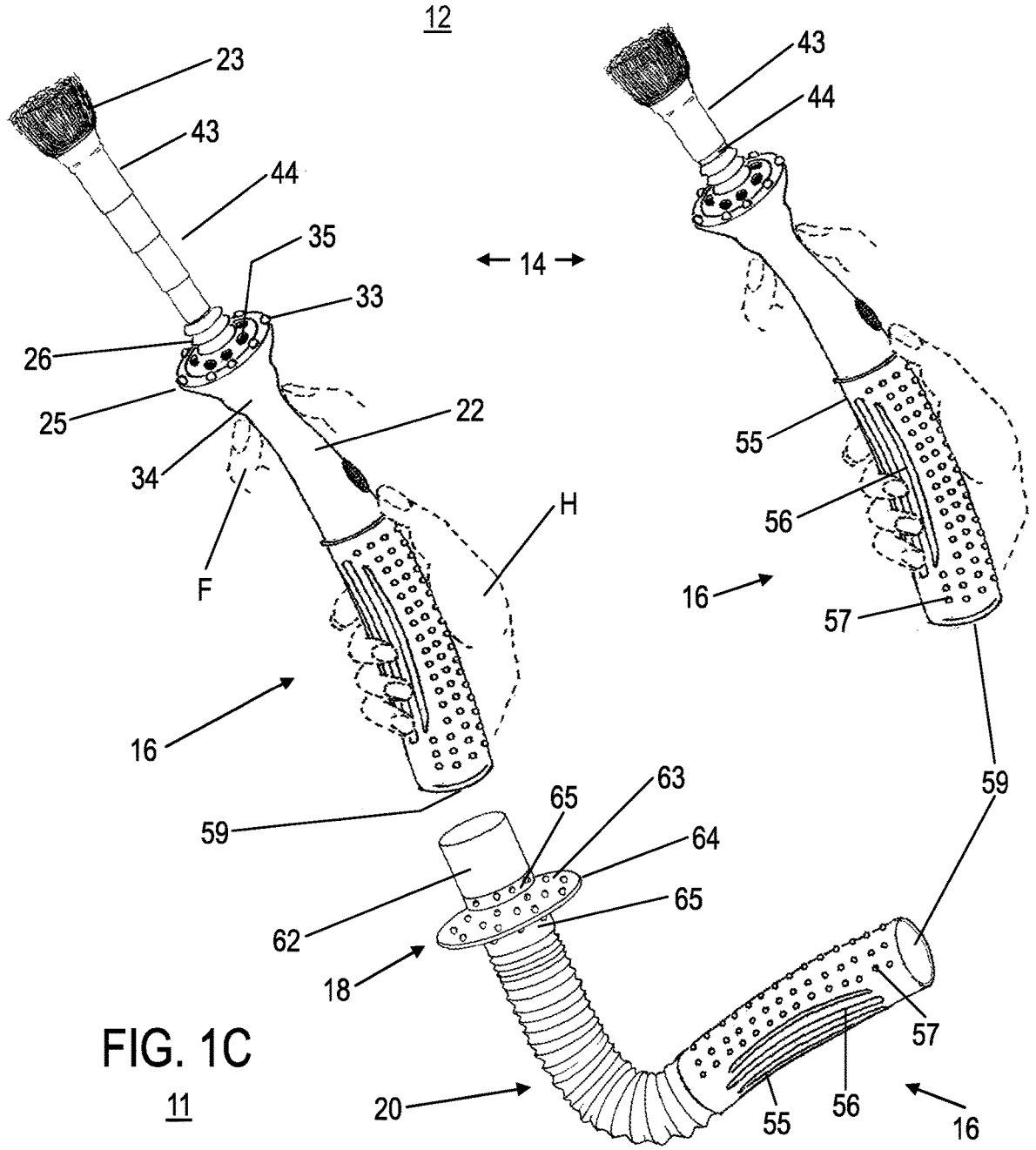
FIG. 1A is an isometric view of the vacuum dusting attachment with the dusting brush in a telescoping position.
FIG. 1B is an isometric view similar to FIG. 1A showing the dusting brush in a non-telescoping position.
FIG. 1C is an isometric view of the optional use accordion hose vacuum attachment of the invention.
Figure 2A:
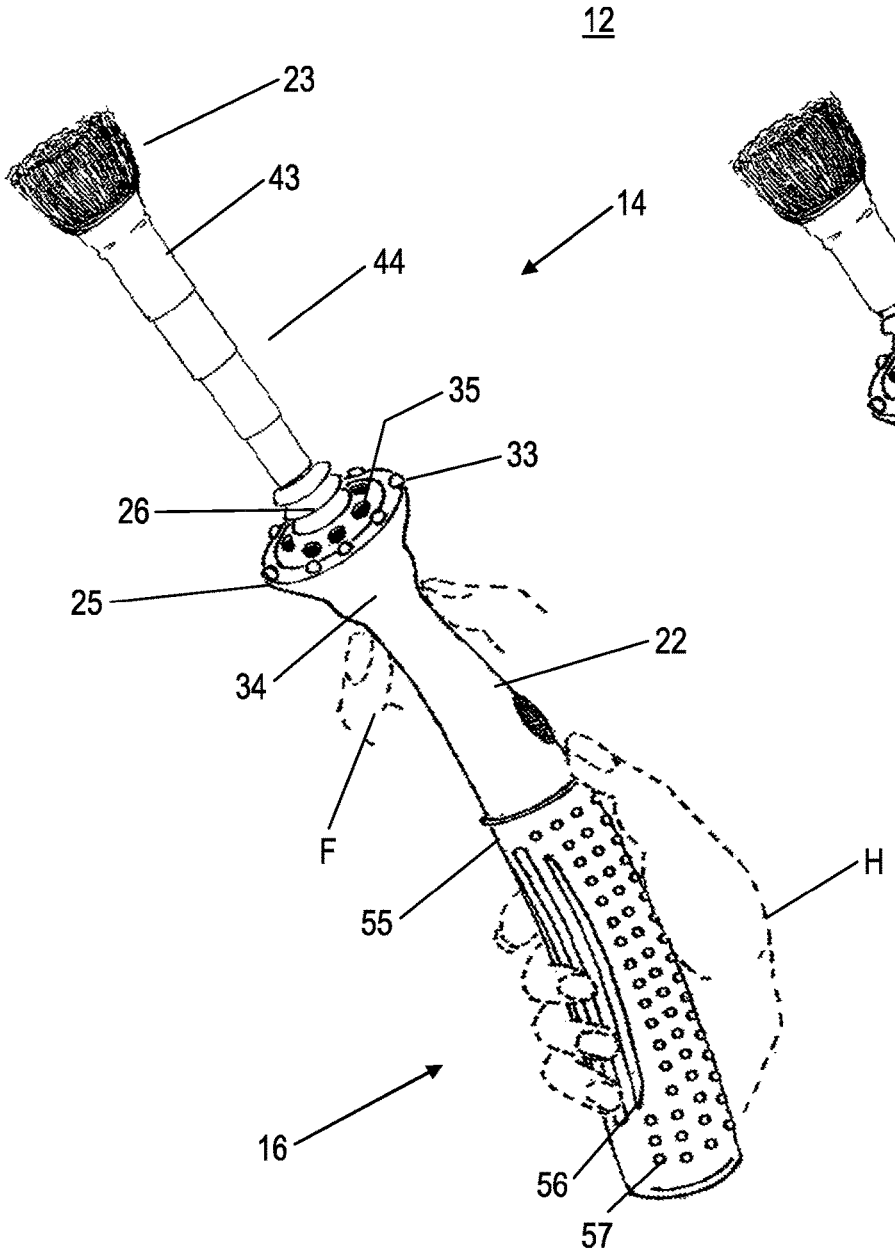
FIG. 2A illustrates the telescoping brush in an expanded position.
Figure 2B:
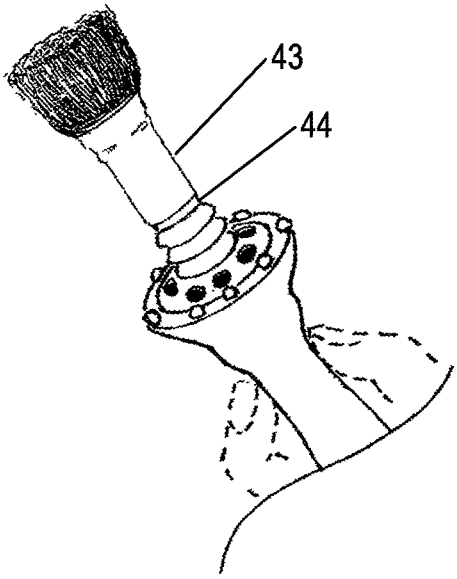
FIG. 2B illustrates the telescoping brush in a retracted position.

Referring now to FIGS. 1, 2, 6, and 10, all of which show a side view of device 12, which represents all sides of the device as being circumferentially similar, but also allows to show the ergonomic slants and shapes of cleaning portion 14 and handle portion 16 of the device 12, and also illustrates two methods of holding the device 12 either in a two finger pinch hold on cleaning portion 14 where an area 34 marked in FIGS. 1A and 2A where the finger F hold is similar to holding a paint brush and providing an ergonomically shaped and comfortable surface, and a hand hold H holds the handle 16 providing proper leverage for cleaning as well as an ergonomically shaped with raised protrusions and comfortable grip for the hand. FIGS. 2-8 show further details of the cleaning portion 14 of device 12.

Referring to FIGS. 1-4 and 6-8 and specifically to the cleaning portion 14 of device 12, viewing from the left side of the illustrations, shown is the "mop style" brush head 23 which may be manufactured in a manner similar to mop paint brushes that are used by artists to paint using various painting mediums. The bristle hairs should be stiff enough not to bend towards the aperture holes 35 located on disk-like portion area 25 while the device is employed, and far enough away not to obstruct the aperture openings, yet soft enough to thoroughly brush out dust from nooks and crannies without damage. Since no apertures are located between the bristles themselves, densely spaced bristles allow complete coverage of an item to be dusted. The aperture holes 35 are specifically sized to collect most of the airborne dust particles lifted from items after being swept or dusted by brush head 23. One end of the bristles of brush 23 are held together and encased a metal base or "ferrule" 43. The upper portion of ferrule 43 will crimp and hold in the bristles of the brush head, while the lower portion of ferrule 43 is incorporated into telescoping portion 44, of which the possible incrementally segmented lengths would be determined during manufacturing. FIGS. 1A, 1D, 2A, and 6A illustrate the telescoping portion 44 extended, while FIGS. 1B, 1E, 2B, and 6B show the telescoping portion 44 in the closed position. The hollow telescoping extension 44 allows any choice of length needed for detailed cleaning. The suction force provided by the vacuum will be sufficient to collect dust disrupted from a surface into the air by the brush 23 when the device telescoping portion 44 is extended.

The base 45 of the telescoping extension 44 (see FIG. 3A), which ideally now as being the supporting bottom of the telescoping assembly is preferably formed as a solid piece of metal which is placed into and adhesively attached along the inside perimeter of rubbery mount 26 which is shown in the Figures with three ridges for identification purposes only. The mount 26 ideally is made of a flexible material, such as a rubber product, so as to allow the brush head to be able to "sway" or move as shown in FIG. 4. Although the mount 26 could be attached securely upon the insert disc 36 where the telescoping extension 44 ends (see FIG. 3A), the possibility of eventually detaching suggests that the telescoping extension along with the mounting material, should be extended further at 46 (FIG. 3B), whereby a center hole 37 is cut in insert cap 36, and the mount 26 is also extended but as a protective coating 27 over the extending telescoping rod 46, and a retaining disc mount 28 is added and then inserted through the hole 37 where it lays on the underside of insert disc 36, or it may be necessary to independently place the disc mount 28 after the coated telescoping extension is placed within the hole 37, which might necessitate a securing bolt and and/or an addition of projecting metal ribs 67 as illustrated in FIG. 4 where in addition to the ribs 67, the outer points of the ribs extend downwards into bendable wire/rods 54, which could then be inserted into open slot pockets 70 formed during the injection molding process, thus further securing and balancing the brush head/ferrule/telescoping assembly especially while it flexes. It is critical that the hole cut out 37 corresponds in size to the combined coated telescope extension to create a snug fit, yet allow the brush head to sway. The coated rod area 27 protects both the metal rod and the cut out hole. To allow the aforementioned assembly, it would be necessary that the disc 36 be a separate piece which could then be popped in or by another means of attachment, into the upper portion 25 of the device 12. This step of having the disc 36 separate not only allows for the insertion of the telescoping brush head, but also allows the insertion of light elements 33 and connecting wire 30 strung from battery chamber 31 (FIG. 5). The use of lights which are powered by batteries is only the example used for illustration purposes and does not indicate that this is the only type of lights and of powering those lights. There could be solar powered lights, or other various charging methods, such as a charging pin port 48 as seen in FIG. 7, incorporating a coefficient conductive material into the devices to be charged by a compatibly equipped and dedicated vacuum unit, and so forth. If the disc 36 is made to be easily removable, the consumer would also have access to the open neck area for replacing/fixing the lighting system, etc., as well as to clean the interior neck 22 of the portion 14 of the device 12 if the need arises.

Continuing to reference the cleaning portion 14 of device 12 and in sequential order, the mop brush head 23, ferrule 43, telescoping extension 44 affixed and attached to mount 26 (see FIG. 3) having the bottom of the mount 26 being affixed or inserted along with the telescoping base 45 and/or 46 to a disk-like portion 36 having holes 35, which may have but not limited to circular shapes, where the cleaning portion 14 becomes hollow within, allowing vacuum suction to take place. Debris is sucked into the open aperture holes 35, through the interior neck area of 22, and through the handle 16, and continues into a vacuum receptacle. FIG. 5 illustrates the flow path of the vacuumed sucked-in debris 38 entering through the open aperture holes 35, where the debris 39 consolidated within the interior neck area 22 and flows through the hollow handle 16, where it continues on to the vacuum receptacle. Within the interior neck area 22, sharing the path of the debris, but not obstructing it, is the wiring 30 for the lights 33, a battery chamber 31, button batteries 52, of which the battery chamber is covered by a soft push on/off button cover 32, of which said cover 32 has an underside area 50 designed to create an airtight enclosure when closed. It should also be noted that the aperture holes 35 could also be any shape, size, or such, and even of different material, such as a screen. The object of device 12 is to collect the majority of dust particles while dusting, so the openings 35 should be large enough to accomplish this task.

Referring now to the plurality of light elements 33 which are located on the outer perimeter disk-like portion 25 of the cleaning portion 14 of device 12, projecting outwards beyond the aperture holes 35, light elements 33 preferably would encircle the aperture openings 35, but the lights are not limited to this placement with the objective being that the lights sufficiently light the overall area to be cleaned with the added bonus of the consumer being able to see the dust particles being collected. Sufficient lighting provided on dusting attachments would be a significant improvement in aiding in the task of dusting in subliminally lighted areas and not usually applied in the vacuum attachment market, mostly only being applied in use on the primary electrically motorized surface cleaning rotary brush component. In one embodiment, the lights 33 encircle the disk-like area 25 on the same plane as the aperture holes 35, as shown in the Figure drawings, or the lights may be placed on the outside perimeter edge, but as mentioned above, not limited to any determined placement since placement will depend upon the most beneficial location to facilitate visual accuracy. The preferred powered lighting would be LED lights or solar powered but battery powered lighting is shown in the Figure drawings. For the purpose of explanation of using the option of battery powered lighting see FIG. 5. Light elements 33 would be attached along a string of wiring 30 which would connect to the battery chamber 31. Using small button 52 or other type batteries, the light elements 33 would be turned on and off by a soft and flexible outside button switch 32, above the battery chamber 31, located on the outer surface of the cleaning portion 14 of the device 12, preferably positioned in an area which would not hinder the handling of the device and/or having the inside battery chamber obstruct substantial amount of vacuum suction flow of dust collected from the aperture holes 35, which passes through the neck area 22 of the cleaning portion 14 of the device 12, and flowing onward to the vacuum collection receptacle.

FIGS. 6A and 6B, which illustrate the telescoping extension in an open or closed position, represents another feature to the neck area 22, whereby a bendable wire/s or rod/s 54, or multiple placements of 54, of desired length, as seen in FIGS. 4 and 5, are encased within the material of the neck area 22 of cleaning portion 14 of the device 12 so as to allow a consumer to be able to bend the forward neck area in certain desired directions which further facilitates the use of the device 12 for awkward directional vacuuming or dusting situations, such as, but not limited to, hard-to-reach areas of computer tower vents.

FIGS. 7 and 8 illustrate possible methods of controlling the vacuum suction strength. FIG. 7 illustrates a circumferential air flow control 40, while FIG. 8 shows an alternative sliding door type air flow control 41, although other air controls arrangement could be utilized. The choice and placement of the air flow control would be determined by the best appropriate and least obstructive area so as not to interfere with the placement of the consumers' fingers F or hand H (FIG. 1) while operating the device 12.

Adjacent the cleaning portion 14 of device 12 is handle portion 16. Referring in particular to FIG. 1 handle portion 16 is designed for gripping by the hand H. The handle portion 16 is hollow and includes an interior nozzle end 59 which is coupled with the nozzle end 62 of accordion hose 11 or to another hose, such that dust collected through the cleaning portion 14 continues on through handle portion 16 to a vacuum receptacle. The gripping area 55 of the handle 16 of device 12 is specifically designed to be ergonomically shaped for comfortable use as it is held by the consumer, such as a padded material placed upon a preferably straight hollow tube, but it may be possible to form the whole handle in one material. The overwhelming design purpose of devices 12 and 11 is to provide lightweight tool attachments for use with a vacuum that are ergonomically comfortable, especially for those consumers who suffer from carpel tunnel syndrome, and other such maladies. The handle 55 is coated/padded or made with soft material such as but not limited to TPR as well as having ridges 56 and/or raised bumps 57 so as to allow for additional hand purchase especially if the hand sweats. The handle 16 can be light weight as long as the nozzle end 59 and the interior portion is rigid, and of adequate length and width, to accept the inserted coupling nozzle of another vacuum hose or wand. The handle on the accordion hose 11 seen in FIGS. 1 and 9, is similar to the handle on device 12, although in an embodiment the handle on the accordion hose may be manufactured shorter eliminating additional length and weight while the accordion hoses are stacked for distance cleaning, but still having a hand hold for the consumer to grab at different interval sections of the stacked hoses during cleaning. Having the coupling portion area of the handle placed internally will aid in lessening weight of the device.

The accordion hose vacuum attachment device 11 (FIG. 9) is lightweight and can be expanded, collapsed, or bent to any desired length or shape. Preferably, the total expansion would be approximately 2 feet which would be a comfortable width for a consumer to pull out to expand or push to collapse the accordion hose using the disk grip 18 and the handle 16, which is the same handle 16 used on device 12. The accordion hose, shown in FIG. 9 and indicating the view 20 of the accordion hose partially collapsed and the view 21 of the accordion hose partially expanded, would be manufactured so the bellow walls would be thick enough to resist collapsing from vacuum suction while extended and to retain any bended direction placed by the consumer. A material for the hose shall have to be rigid, such as but not limited to a plastic material, but yet flexible so as to avoid cracking with repeated usage. The advantage of using the accordion hose is that it is lighter, bendable, and can telescope within its extendable manufactured length to any length desired as well as reaching specific target areas, and additional accordion hose vacuum attachments of device 11 can be coupled together to add more extension when needed and there will always be a handle to grasp. The other advantage is that the hose collapses approximately a third of the fully extended hose making the accordion hose vacuum attachment 11 ideal for storage and carrying while cleaning as opposed to using long rigid extension hoses. Using the grip disk/s 18 and handle 16 makes it easier to pull outwards to expand the length of the hose and push inwards to collapse the hose, while the handle can be used to hold and direct the accordion hose.

The grip disk 18 (labeled in FIGS. 1C and 9) is made of a sturdy material but if need be is coated with soft material such as the handle 16 which is the same handle used on the vacuum dusting attachment 12 featuring the raised bumps and/or ridges, and the outside rim 64 is cushioned for comfort of the hand. The soft material on the disk continues as the disk diminishes to the rounded size area 63 and 65 that corresponds to the circumference of the nozzle end on the one side and the accordion hose on the alternate side.

Referring again to the accordion hose vacuum attachment device 11, it should be noted that if it is attached directly behind the vacuum dusting attachment device 12, or another attachment, the hose can extend the attachment to reach distant areas, but when close up cleaning is desired and the consumer is handling the vacuum dusting attachment 12, the accordion hose vacuum attachment would now be situated and trailing behind the consumer, allowing a fluidity of a swinging motion, extension, and unobstructed movement while the consumer is engaged using the vacuum attachment.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A dusting attachment for a vacuum cleaner comprising:

a cleaning portion including a brush head formed of a plurality of densely packed soft and pliable bristles held together and encapsulated on an end by a ferrule, an incrementally segmented telescoping extension having opposed ends, one end thereof being secured to the ferrule, allowing for exacting choices of various lengths by extension and/or collapsing of said extension, and another end of the telescoping extension forming a flexible mount base connected at a central location to a disc-like cap member, the connection of the flexible mount base to the cap member defining an axis point allowing for pivotal swaying of the extension and brush head with respect to the cap member when the brush head contacts items to be cleaned;

said disc-like cap member having one or more open apertures therein positioned around the extension flexible mount base;

a hollow longitudinal extended neck area having an internal wall defining an interior channel with opposed open ends, a forward neck area, and a narrowed outer width intermediate of said ends forming a finger holding area to facilitate holding the dusting attachment like a writing instrument, said cap member secured to the forward neck area on an open end of the interior channel, and one or more light elements secured around the open end of the interior channel in the forward neck area, and an integrated coupler and ergonomic handle having one end connected to the neck area of the cleaning portion, an opposite coupling end, a dedicated hand gripping area that is ergonomically shaped for the accommodation of a full palm hand, and an interior channel in communication with the interior channel of the neck area, wherein when the coupling end of the integrated coupler and handle is coupled with an intake hose connected to the vacuum cleaner, a suction force generated by the vacuum cleaner will cause dust and debris to be pulled inwardly through the open apertures of the disc-like cap member through the interior channels of the neck portion and integrated coupler and handle and the vacuum cleaner intake hose into the vacuum cleaner debris receptacle where the accumulated dust/debris is collected.

2. The dusting attachment of claim 1 wherein the coupling end of the integrated coupler and handle is releasably connected to an end coupling of an accordion hose device, said device including an accordion hose section having a predetermined circumferential diameter, and a pull/push disk attached adjacent to said end coupling and accordion hose section that provides a handling area for the accordion hose device and which is outwardly projecting beyond the circumferential diameter of the accordion hose section, said accordion hose section formed of a sturdy material and containing shaped bellow segments for purposeful selection of various hose section length expansion or hose shortening, or collapsing for compact storage, as well as various alternative bend configurations, and a duplicate of said ergonomically shaped integrated coupler and handle secured on an end of the accordion hose device opposite the end coupling, wherein the coupling end of the duplicate integrated coupler and handle is configured to be coupled with the intaking vacuum cleaner's hose or to the coupling end of an additional accordion hose device to further increase the overall length of the connected hose devices to allow less movement/dragging of the vacuum cleaner into a desired cleaning range, thus allowing less interruption and unobstructed freedom of movement by a user while moving around an area to be cleaned.

3. The dusting attachment of claim 2 wherein the pull/push disc portion of the accordion hose is covered with an overlay of cushioned padding having raised gripping bumps to improve the user's gripping power when gripping the pull/push disc in order to adjust the position of the accordion hose device.

4. The dusting attachment of claim 1 wherein the brush head is a mop style brush which allows for indiscriminate detail cleaning.

5. The dusting attachment of claim 1 additionally comprising a center cut out hole in the cap member through which an end portion of the flexible mount base of the telescoping extension is passed, and a retaining disc mount having a diameter greater than the center hole which is secured to the end portion in a position against an underside of the cap member, thereby securing and stabilizing the extension and brush head.

6. The dusting attachment of claim 5 wherein the disc-like cap member containing the center cut out hole and the open apertures is detachable from the forward neck area.

7. The dusting attachment of claim 5 additionally comprising one or more supporting ribs connected to the end portion of the flexible mount base extending out towards the internal wall of the neck area without substantially blocking the open apertures to increase the stability of the telescoping brush.

8. The dusting attachment of claim 7 additionally comprising retaining pocket-like slots on the internal wall of the interior channel of the neck area which receive downward extensions of the supporting ribs after reaching said internal wall, adding further stability for the telescoping brush.

9. The dusting attachment of claim 1 wherein the neck area further comprises a molded material encasing a circumferentially spaced and longitudinally oriented array of bendable wiring to allow for maintaining a selected directional bending of the forward neck area of the cleaning portion in order to facilitate cleaning of specific targeted areas.

10. The dusting attachment of claim 1 wherein the neck area further comprises a battery chamber configured to hold one or more batteries that power the light elements which are connected to the battery chamber by electrical wiring in the neck area.

11. The dusting attachment of claim 10 wherein the batteries are rechargeable using solar power, or with the placement of pin ports on the neck area which are connectable to pins of a charging device.

12. The dusting attachment of claim 11 wherein the battery chamber further comprises a cover devised with an air tight underside, and a soft and flexible on/off switch button on the outer surface of the neck area in a position allowing for easy access by the user.

13. The dusting attachment of claim 1 wherein the neck area further comprises an adjustable vent for controlling the vacuum cleaner suction velocity by opening and closing said vent.

14. The dusting attachment of claim 1 wherein the ergonomically shaped integrated coupler and handle further comprises an overlay of cushioned padding for added comfort for the user's hand, and raised gripping bumps and ridges on said cushioned padding for preventing slippage of the hand and improving grip security.

15. The dusting attachment of claim 1 in which the integrated coupler and handle is detachable from the cleaning portion.

16. The dusting attachment of claim 15 wherein the integrated coupler and handle is releasably connected on the coupling end to an accordion hose device including an accordion hose section having a predetermined circumferential diameter, and a pull/push disc attached adjacent to opposite ends of the accordion hose device.

17. The dusting attachment of claim 15 additionally comprising a coupler of adjustable length having an ergonomic hand gripping area, said coupler configured to connect between pairs of said accordion hose devices.

18. A handle equipped vacuum dusting attachment device comprising:

a cleaning portion including an elongated neck area and a dusting portion; and, an integrated coupler and handle;

the neck area having a longitudinally extending interior channel, a forward neck area, an opposite nozzle end, and a narrowed outer width intermediate of said forward neck area and opposite nozzle end forming a finger holding area to facilitate holding the dusting attachment like a writing instrument, the finger holding area circumferentially widening towards the forward neck area and opposite nozzle end, the forward neck area being manually selectively directionally bendable in order to facilitate cleaning of specific targeted surfaces, and a disc-shaped end cap connectable to the forward neck area covering an open end of the interior channel, said end cap having a plurality of dust and debris collecting apertures;

the dusting portion including a mop-style brush head connected to an end of a telescoping extension, said extension connected on another end to the end cap by a flexible mount base, said base defining an axis point allowing for pivotal swaying of the extension and brush head with respect to the end cap when the brush head contacts items to be cleaned; and the integrated coupler and handle connected to the nozzle end of the neck area and having a coupler end, an interior channel in fluid communication with the interior channel of the neck area, and a dedicated hand gripping area ergonomically shaped to accommodate a full palm hand grip.

19. The vacuum dusting attachment device of claim 18 additionally comprising one or more light elements secured along an outer perimeter of the forward neck area.

* * * * *